US005991422A

United States Patent [19]

Chiang

[11] Patent Number: 5,991,422

[45] Date of Patent: Nov. 23, 1999

[54] STRUCTURAL IMPROVEMENTS OF EARPHONE SIGNAL CORD

[76] Inventor: Chao-Ning Chiang, No. 3, Lane 20, Ching-Li Street, Tu Cheng, Taipei Hsien, Taiwan

[21] Appl. No.: 09/162,359

[22] Filed: Sep. 29, 1998

[51] Int. Cl.[6] ..... H04R 25/00

[52] U.S. Cl. ..... 381/370; 381/384; 381/371

[58] Field of Search ..... 381/370, 371, 381/374, 384; 379/438, 430, 431, 451; 181/129, 137; 439/489, 188

[56] References Cited

U.S. PATENT DOCUMENTS 5,406,637 4/1995 Gonzalez ..... 381/154
5,623,132 4/1997 Gahm ..... 181/156

FOREIGN PATENT DOCUMENTS 5-176384 7/1993 Japan ..... 381/159

*Primary Examiner*—Sinh Tran
*Attorney, Agent, or Firm*—Bacon & Thomas

[57] ABSTRACT

A structural improvement of earphone signal cord, involving mainly a layer of fabric structure woven in Chinese-knot style to coat the conductive wire of an input plug, the input plug is then coated and fixed by a wooden sleeve, the other end of the conductive wire is fitted inside a wooden casing, inside the wooden casing is fitted a speaker, on the wooden casing is a hole unit, so designed that the fabric structure outside the conductive wire can be fixed inside the hole unit; with the aforementioned construction, since the conductive wire is coated by a layer of fabric structure, thereby the fabric structure will increase the strength of the conductive wire to prevent it from being pulled apart, and from being twisted or deformed, so that its original appearance can be maintained for a extended period of time.

1 Claim, 3 Drawing Sheets

STRUCTURAL IMPROVEMENTS OF EARPHONE SIGNAL CORD

BACKGROUND OF THE INVENTION

A structural improvement of earphone signal cord, involving mainly a layer of fabric structure that is woven in a Chinese-knot style to coat the conductive wire of an input plug, the input plug is then coated and fixed by a wooden sleeve, the other end of the conductive wire is fixed in a wooden casing that contains a speaker, thereby the fabric structure will increase the strength of the conductive wire to prevent it from being pulled apart, or from twisting or deformation of the conductive wire.

Conventionally, the conductive wire in a superior-quality earphone applied to the connection to a hifi equipment is generally made of spiral PU coils, in actual application, however, said spiral PU coil can be freely extended or retracted to suit the position of the user, but because of its spiral configuration, it would often be twisted in application, resulting in inconveniences.

We have also seen a regular conductive wire used as a connection cord, which will not be twisted, but since it has to be coiled for storage purpose, the conductive wire will often be folded and curled up, resulting in distorted appearance of the conductive wire which becomes not so pleasing to the eye; and, said conductive wire is generally made of copper wire coated by an insulating covering, lacking the flexibility of the above spiral PU coil, resulting in frequent pulling apart at the joint of the conductive wire due to forceful pulling, or misconnection that is caused by forceful pulling, therefore, it does involve some inconveniences.

As mentioned above, the conventional PU coil for a regular earphone can be easily twisted due to its spiral shape, resulting in inconveniences in actual application; while a regular straight-line conductive wire lacking flexibility when it is subjected to pulling force would often be pulled apart, or resulting to misconnection due to the pulling force; in view of the above shortcomings, the inventor has devoted in the research and has finally designed a conductive wire to be connected to an earphone, by coating the conductive wire of an input plug with a Chinese-knot style fabric structure, the input plug is then coated and fixed by a wooden sleeve, the other end of the conductive wire is fitted inside a wooden casing, inside the wooden casing is fitted a speaker, and on the wooden casing is a hole unit, so the fabric structure outside the conductive wire will be fixed into the hole unit; with the aforementioned construction, since the conductive wire is coated by a layer of fabric structure, said fabric structure will serve to increase the strength of the conductive wire to prevent it from being pulled apart, or from being twisted or deformed, so that its appearance can be maintained after extended use.

SUMMARY OF THE INVENTION

The primary objective of the present invention is to present a type of input plug which conductive wire is coated by a layer of fabric structure that is woven in a Chinese-knot style, the input plug is then coated and fixed by a wooden casing, the other end of said conductive wire is fixed in a wooden casing that contains a speaker, thereby said fabric structure serves to increase the strength of the conductive wire, to prevent it from being pulled apart, curled, twisted or deformed, and to maintain its appearance.

To enable better understanding of the invention, the following drawings are described in details.

DETAILED DESCRIPTION OF PREFERRED EMBODIMENT

Figure 1:
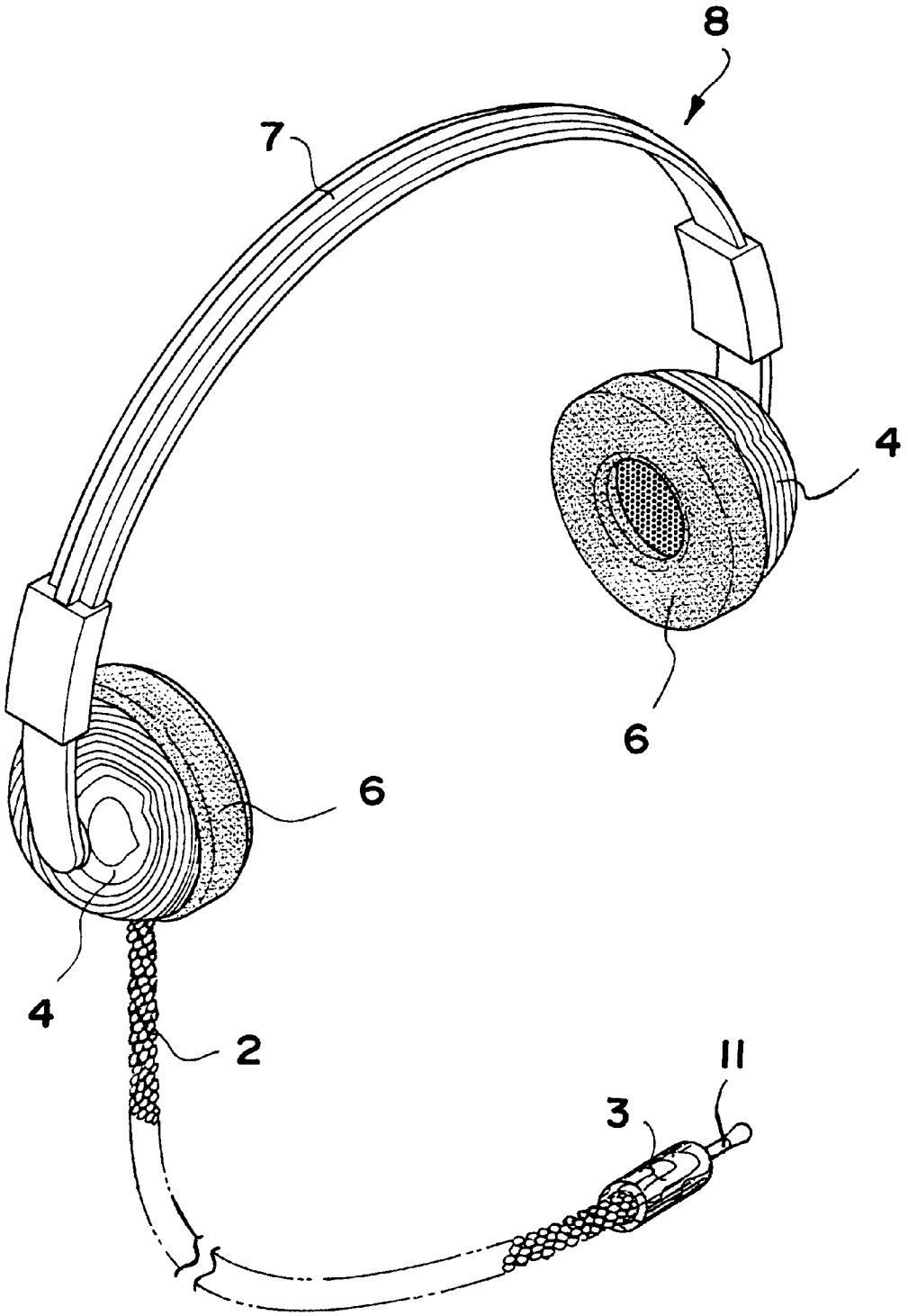
FIG. 1 is a perspective view of the invention.
Figure 2:
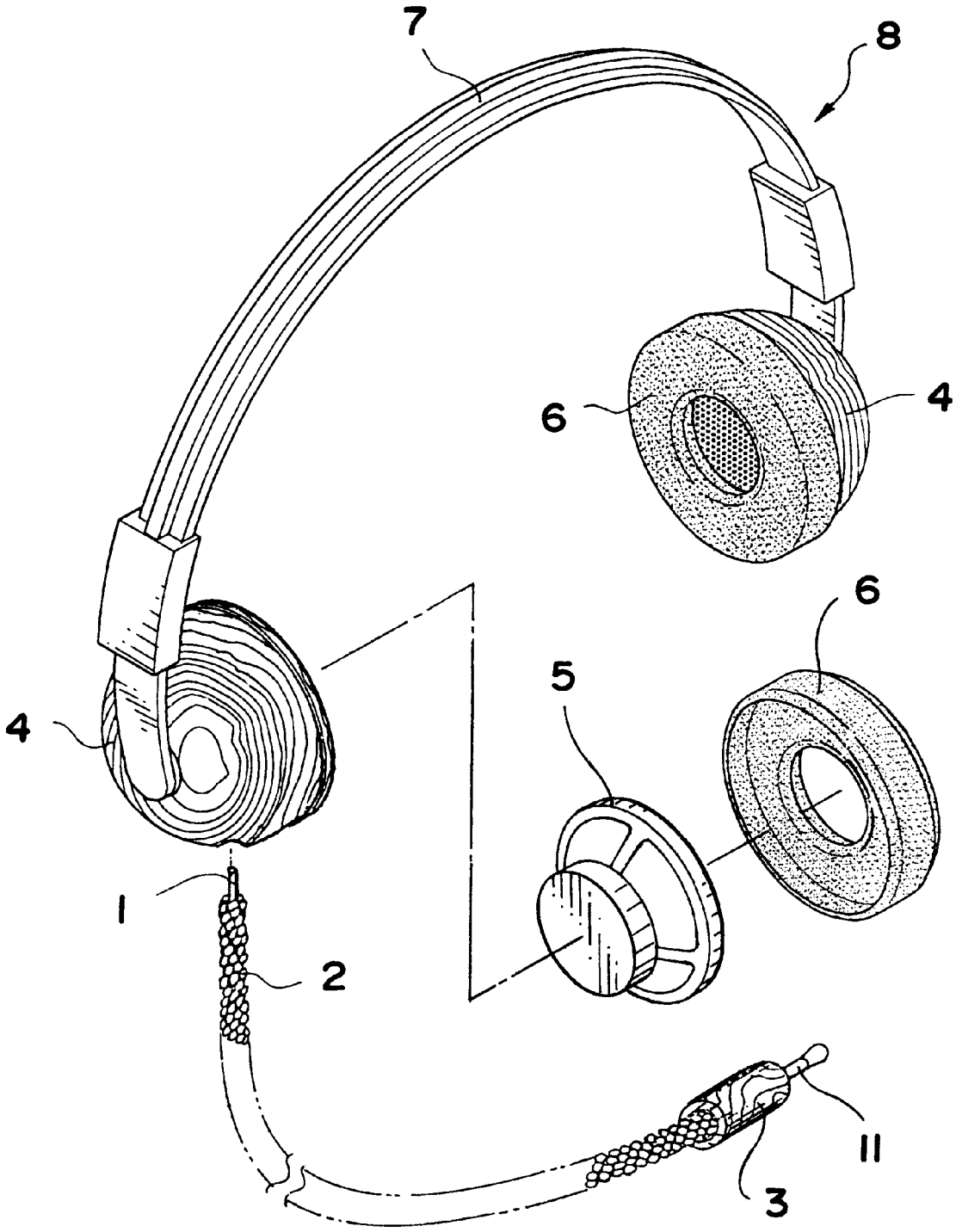
FIG. 2 is an exploded view of the invention.
Figure 3:
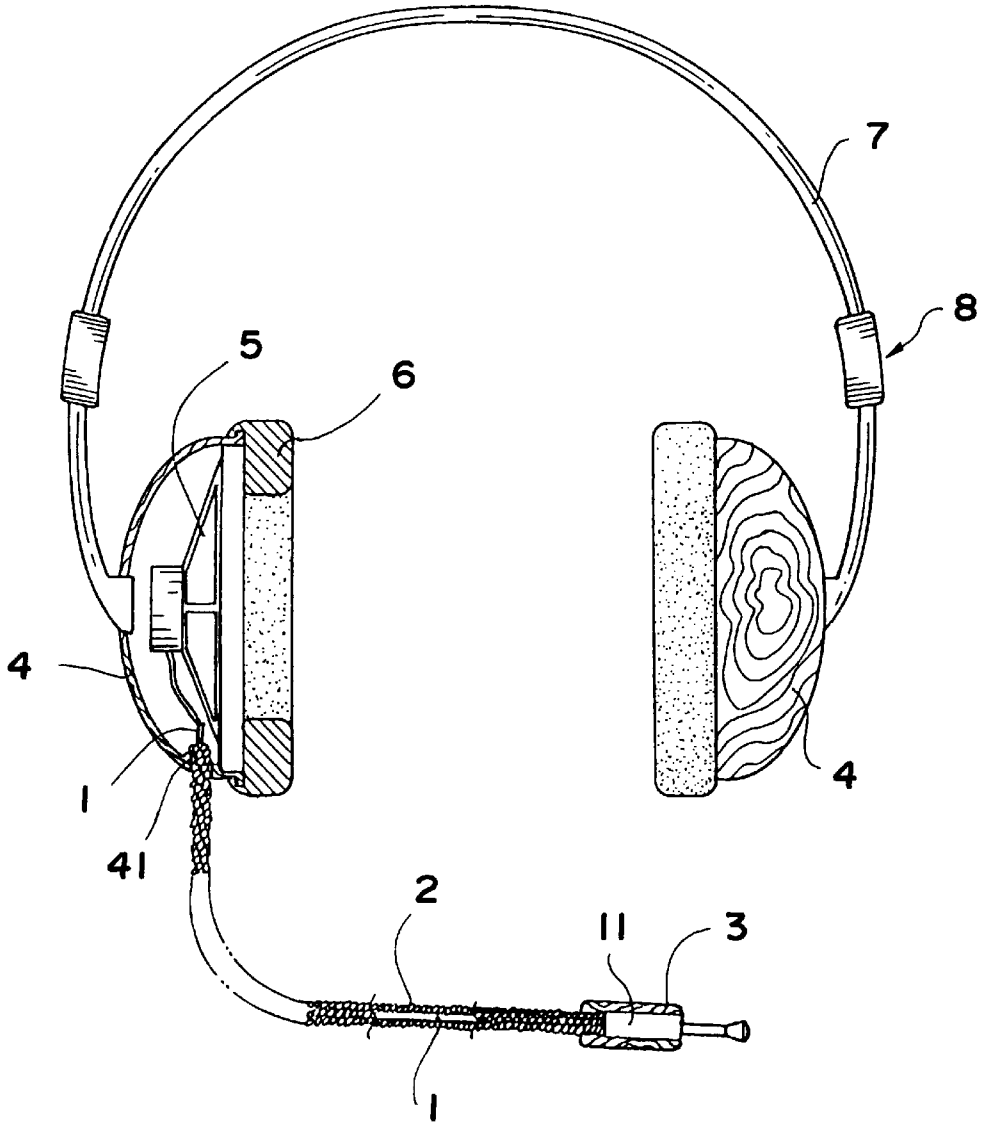
FIG. 3 is a section view of the invention.

Referring to FIGS. 1, 2 and 3, the invention relates mainly to an input plug 11 which conductive wire 1 is coated by a Chinese-knot style fabric structure 2, the input plug 11 is then coated and fixed by a wooden sleeve 3, the other end of said conductive wire 1 is fixed in a wooden casing 4, inside the wooden casing 4 is fitted a speaker 5, on said wooden casing 4 is a hole unit 41, the fabric structure 2 coated outside said conductive wire 1 is fixed inside the hole unit 41.

On the opening of the wooden casing 4 is a protective cover 6, said wooden casings 4 opposite each other, the two wooden casings 4 are joined by a head band 7, to compose a headphone 8.

In the aforementioned construction, since said conductive wire 1 is coated by the fabric structure 2, said fabric structure 2 serving to enforce the strength of the conductive wire 1, to avoid it from being pulled apart, thereby protecting said conductive wire 1; since said fabric structure 2 is fixed to the joint of the earphones, it will increase the strength of the joint to prevent the conductive wire 1 from being pulled apart at the joint, or from misconnection that may be caused by forceful pulling.

Since the outside of said conductive wire 1 is coated by the fabric structure 2, when it is wound up for storage purpose, its outside surface will not be curled, twisted or deformed, therefore, its outside appearance can be kept the way it was, even after extended use.

The speakers 5 at two sides of said headband-style earphone 8 is fitted inside the wooden casing 4, the outside of the input plug 11 of the conductive wire 1 is coated by the wooden sleeve 3, and said conductive wire 1 is coated by the fabric structure 2, so its integral configuration may demonstrate a special style.

Since the conductive wire 1 is coated by the fabric structure 2, and said fabric structure 2 may be woven in any possible colors, there can be a wide range of various combinations of various colors to satisfy the demand for variety of designs.

What is claimed is:

1. A structural improvement of earphone signal cord, involving mainly a layer of fabric structure woven in Chinese-knot style to coat the conductive wire of an input plug, the input plug being then coated and fixed by a wooden sleeve, the other end of said conductive wire being fitted inside a wooden casing, inside said wooden casing being fitted a speaker, on said wooden casing being a hole unit, so designed that said fabric structure outside the conductive wire can be fixed inside said hole unit.

* * * * *